US005685810A

United States Patent [19]

Chung

[11] Patent Number: 5,685,810

[45] Date of Patent: Nov. 11, 1997

[54] LEG EXERCISE EQUIPMENT

[76] Inventor: Chang Chien Chung, 11F-1, 342, Sec. 1, Keelung Rd., Taipei, Taiwan

[21] Appl. No.: 649,870

[22] Filed: May 13, 1996

[51] Int. Cl.[6] ..... A63B 21/008; A63B 23/035

[52] U.S. Cl. ..... 482/112; 482/100; 482/113

[58] Field of Search ..... 482/100, 112, 482/113, 137, 145

[56] References Cited

U.S. PATENT DOCUMENTS

| | | | |
|---|---|---|---|
| D. 255,136 | 5/1980 | Brentham | 482/112 |
| 3,638,941 | 2/1972 | Kulkens | 482/113 |
| 4,429,871 | 2/1984 | Flechner | 482/112 |
| 4,621,807 | 11/1986 | Stramer | 482/100 |
| 5,094,450 | 3/1992 | Stearns | 482/130 |
| 5,186,702 | 2/1993 | Amanze | 482/145 |

FOREIGN PATENT DOCUMENTS

| | | | |
|---|---|---|---|
| WO 81/01662 | 6/1981 | WIPO | 482/112 |

*Primary Examiner*—Richard J. Apley
*Assistant Examiner*—William LaMarca
*Attorney, Agent, or Firm*—W. Wayne Liauh

[57] ABSTRACT

A leg exercise equipment is disclosed, which includes a base plate, a supporting frame foldably mounted to the base plate, and a crank mechanism. The crank mechanism includes a swinging arm, of which one end is connected with a hydraulic cylinder through a shaft. The other end of the hydraulic cylinder is connected with a connecting pin which is fixedly fastened to the supporting frame. A leg holder is mounted on one end of the swinging arm. When the user's leg exerts force to the leg holder, the force will be transmitted to the hydraulic cylinder to drive the same to move back and forth so as to cause the leg muscle and hip muscle to be exercised evenly.

6 Claims, 4 Drawing Sheets

LEG EXERCISE EQUIPMENT

FIELD OF THE INVENTION

This invention relates to a leg exercise equipment, and particularly to a leg exercise device which allows the user's leg muscle or hip muscle to be exercised evenly.

BACKGROUND OF THE INVENTION

Loving beauty is a natural desire of every one, and it is particularly true to the female gender. Therefore, the market has been provided with various types of gymnastic apparatuses for consumers so as to help them obtain a beautiful and healthy body.

In view of most females suffering from much excrescence in leg part or hip part, the inventor has developed a leg exercise device in accordance with the human engineering theory. Such a exercise device can help the female exercise the leg and hip muscle so as to reduce the excrescence and to obtain a beautiful figure.

SUMMARY OF THE INVENTION

The prime object of the present invention is to provide a leg exercise device, which has a hydraulic cylinder for furnishing a damping force to a user to exercise the leg muscle and hip muscle so as to remove the excrescent muscle therein.

Another object of the present invention is to provide a leg exercise device, which can be folded up to facilitate shipping or storage, if necessary.

DETAILED DESCRIPTION

Figure 1:
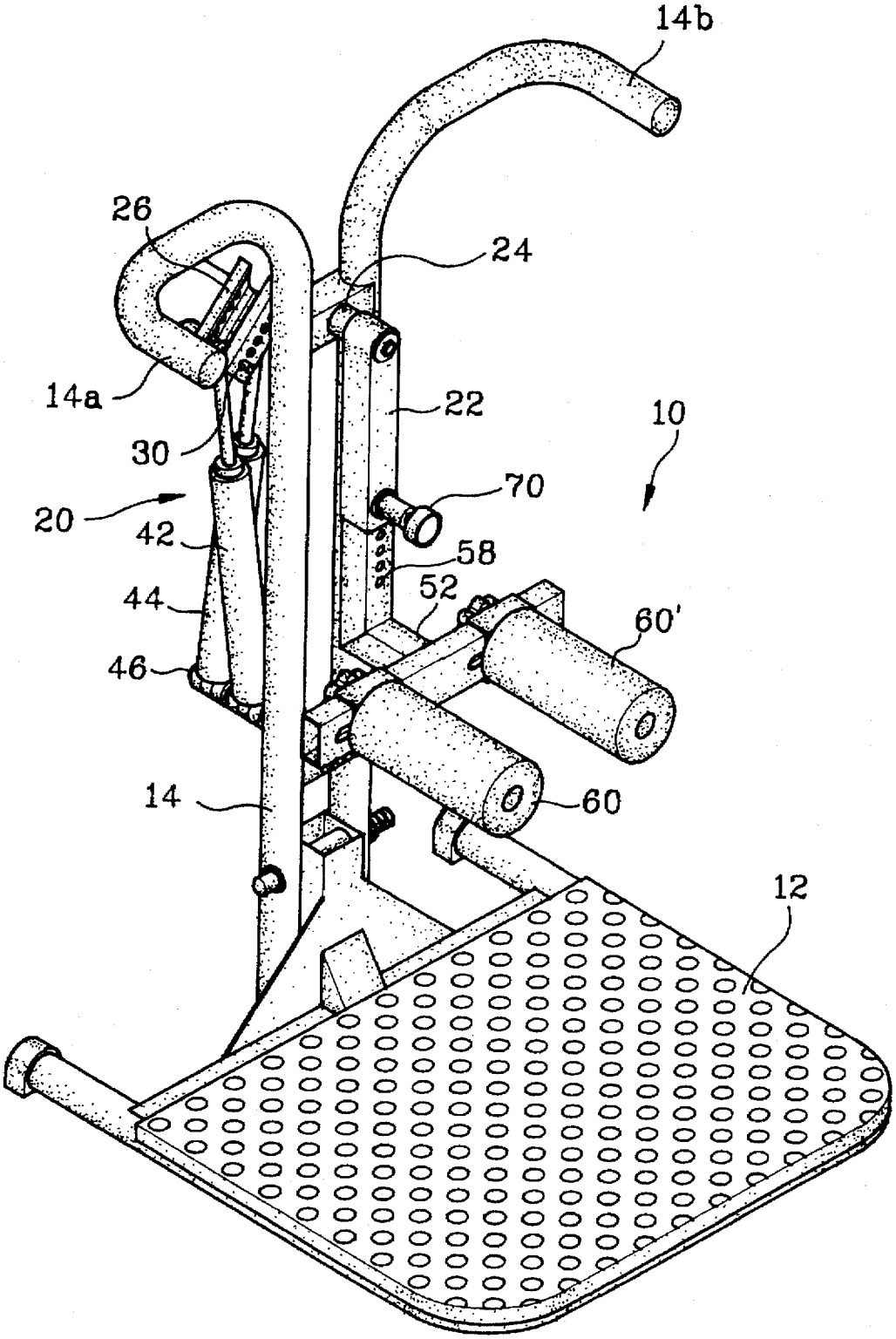
FIG. 1 is a perspective view of an embodiment according to the present invention.
Figure 2:
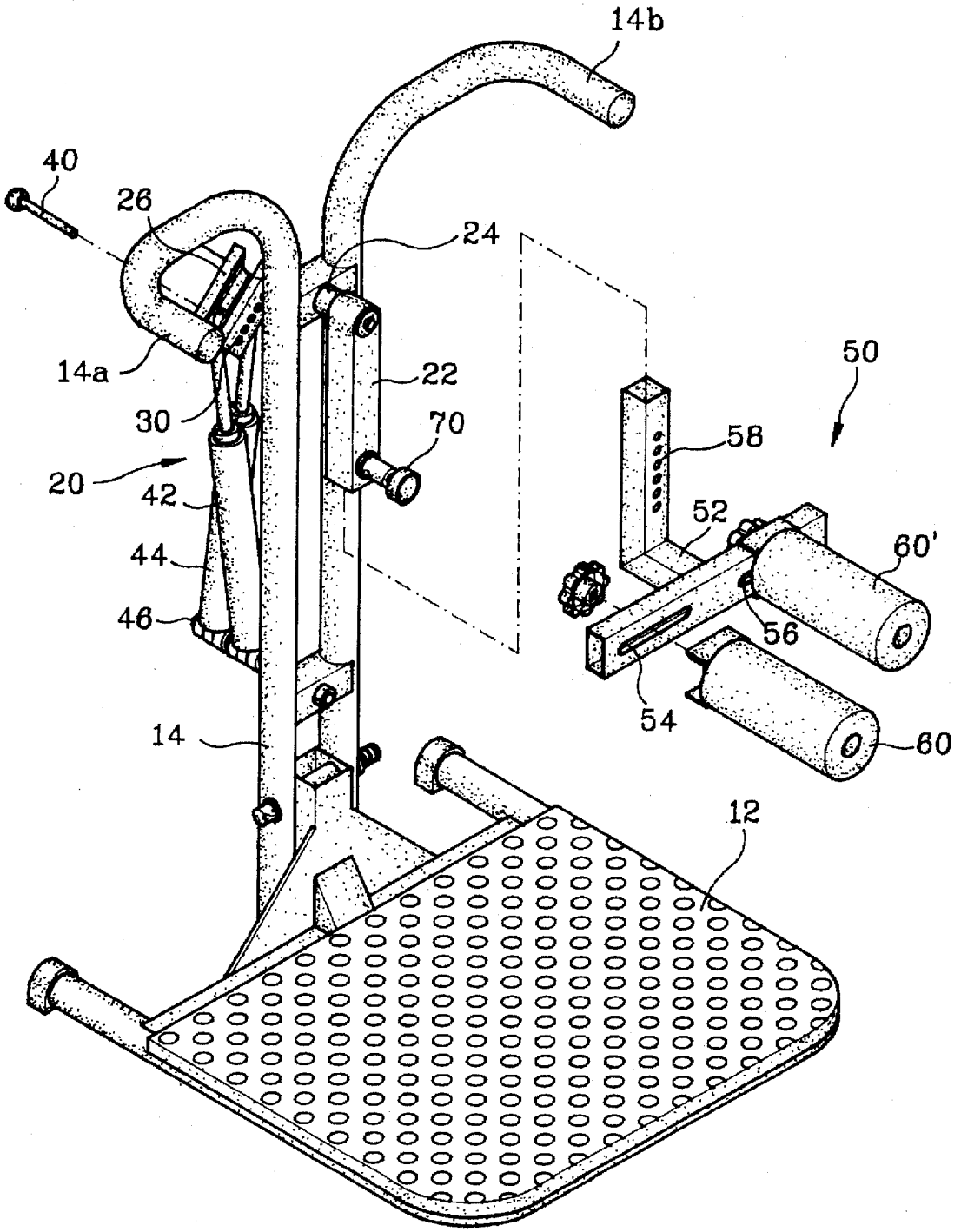
FIG. 2 is a disassembled view of the present invention.
Figure 6:
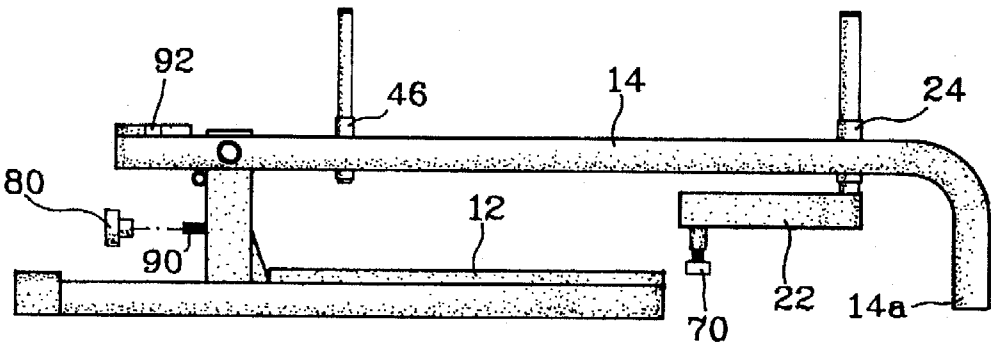
FIG. 6 is a side view of the present invention (after being folded).
Figure 5:
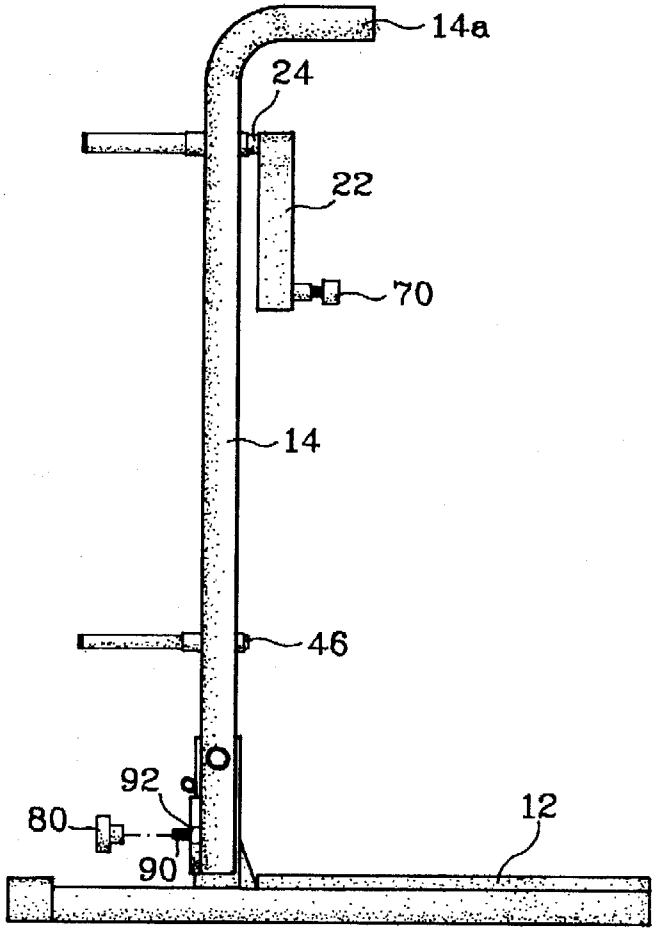
FIG. 5 is a side view of the present invention (before being folded).

Referring to FIGS. 1 and 2, the leg exercise device according to the present invention comprises a base plate 12, and a supporting frame 14. The supporting frame 14 is pivotally connected with the base plate 12 so as to enable the present invention to become a foldable device, and to reduce the size thereof to facilitate shipping and storage (as shown in FIGS. 5 and 6). The base plate 12 is provided with a fastening screw 90, which passes through a through hole 92 in the supporting frame 14. Then a nut 80 is fastened to the fastening screw 90 so as to cause the supporting frame 14 to be fixed in place. The upper ends of the supporting frame have two grips 14*a* and 14*b*, respectively. A crank mechanism 20 in the present invention includes a swinging arm 22, one end of which is connected with a shaft 24 attached pivotally to the supporting frame 14. The shaft 24 is fixedly mounted with a first connecting rod 26 and a second connecting rod 28. The two connecting rods are mounted in symmetrical positions. Both of the connecting rods are provided with a plurality of holes 30 and 32, respectively. By means of a pin 40 and one of the holes 30, the first connecting rod 26 can be connected with the first hydraulic cylinder 42 and the same is true for the second connecting rod 28. The other ends of the first and second hydraulic cylinders 42 and 44 are pivotally connected with a connecting pin 46, which is fixedly fastened to the supporting frame 14. A leg holder 50 with a connecting member 52 is connected with the swinging arm 22 in an adjustable manner so as allow adjust the height of the leg holler 50 to be adjusted, if necessary. The swinging arm 22 has a fastening pin 70, while the connecting member 52 is furnished with a plurality of holes 58. The fastening pin 70 can be plugged in one of the holes 58 in the connecting member 52. The connecting member 52 is furnished with two elongated slots 54 and 56 to be mounted, in an adjustable manner with two handles 60 and 60' respectively so as to adapt to the leg size of a user. It is apparent, according to the aforesaid description, that the present invention is rather easy to assemble and disassemble to facilitate shipping and selling.

Figure 4:
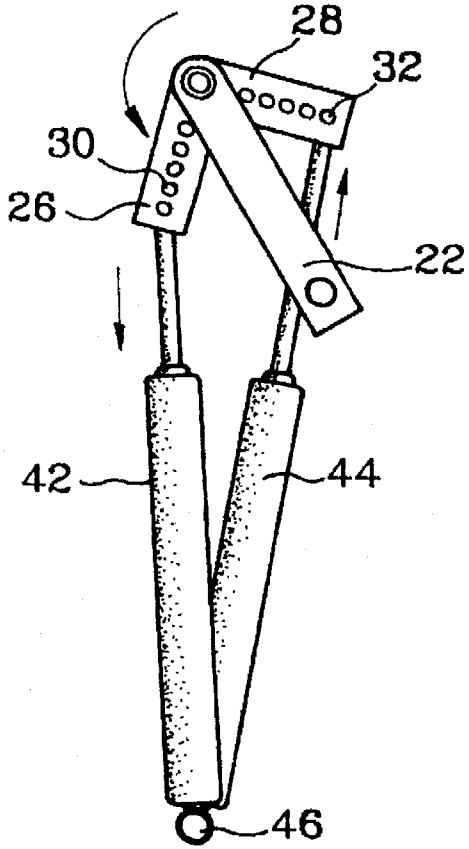
FIG. 4 is a fragmental perspective view of the present invention, showing operation condition-2.
Figure 3:
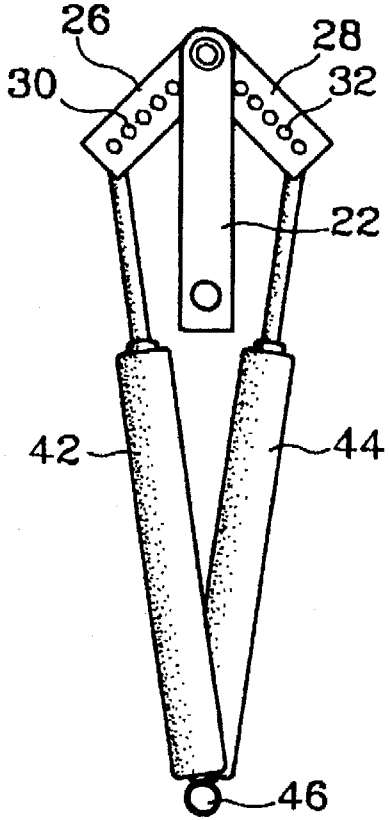
FIG. 3 is a fragmental perspective view of the present invention, showing operation condition-1.

To operate the present invention, the user should put a leg between the two handles 60 and 60' of the leg holder 50, and hold one or both of the grips 14*a* or 14*b* with his or her hand. The user should lift up his (or her) leg to overcome the counter force of the first hydraulic cylinder 42 or the second hydraulic cylinder 44 by moving the swinging arm 22 of the leg holder 50 (as shown in FIGS. 3 and 4). When the user moves the leg holder 50 back and forth, the hip muscle and leg muscle will be subject to a suitable exercise. Since a pulling force or a compression force to the hydraulic cylinder is almost a constant value, the angle and force to move the swinging arm 22 by a user is almost the same. Therefore, the user can cause his (or her) leg muscle and hip muscle to be exercised evenly so as to obtain a beautiful and healthy result. This enhances the user's interest in doing such exercise. In the event of feeling too much force or too small force required to operate the leg holder 50, the user may adjust the connection position of the hydraulic cylinders 42 and 44, i.e., to one hole up or down along the connecting rod until the suitable force being found so as to obtain the best exercise result.

As mentioned above, the supporting frame 14 of the leg exercise device 10 is pivotally connected with the base plate 12. When shipping or storage is necessary, the supporting frame 14 can be folded up by removing the nut 80 (as shown in FIGS. 5 and 6 ) so as to reduce the dimensions thereof.

Further, the base plate 12 of the present invention can be added with a set of castors to facilitate moving the equipment (not shown).

The handles 60 or 60' of the present invention can be gripped with a user's hand, i.e., to turn the swinging arm 24 with hand so as to drive the hydraulic cylinder with hand force for hand muscle exercise.

However, the leg exercise device according to the present invention can also use other means instead of hydraulic cylinder, such as an elastic rubber tube, an elastic rubber belt, or other damping devices to a pulling force or a compression force without affecting the muscle exercise function.

In brief, the present invention is deemed to have advantages as follows:

(1). The leg exercise device according to the present invention comprises hydraulic cylinders with connecting rods to provide a proper exercise function for leg muscle and hip muscle.

(2). The connecting position of the hydraulic cylinder can be adjusted in accordance with the user's physical condition so as to obtain maximum exercise result.

(3). The width of the leg holder can be adjusted so as to adapt to a user's leg size.

(4). The height of the leg holder can be adjusted so as to adapt to a user's leg length.

(5). The present invention can be folded up to facilitate shipping or storage.

(6). The present invention can be assembled without using any tool.

(7). The handles of the present invention can also be used to perform hand muscle exercise.

I claim:

1. A leg exercise device comprising:

a base plate allowing a user to stand thereupon;

a supporting frame mounted on said base plate;

a crank mechanism including a swinging arm, of which one end having a shaft pivotally connected with said supporting flame; said shaft being fixedly mounted with a first connecting rod and a second connecting rod symmetrically; each of said connecting rods being connected with a damping device, and the other end of each said damping device being connected with a connecting pin which is fixedly mounted on said supporting frame; and an adjustable leg holder which includes a connecting member, and said connecting member is connected with said swinging arm in a length-adjustable manner so as to adapt to a user's leg length; wherein said connecting member has two elongate slots mounted with two handles respectively in an adjustable manner so as to have the space between said two handles adjusted to adapt a user's leg size; whereby the user's leg is able to apply force to said leg holder, which transmits said force to said damping device so as to perform exercise for hip muscle or leg muscle.

2. A leg exercise device as claimed in claim 1, wherein each of said connecting rods is provided with a plurality of holes; one end of said hydraulic cylinder able to connect with said connecting rod through one of said holes by means of a pin so as to provide different damping force for a user's leg.

3. A leg exercise device as claimed in claim 1, wherein said connecting member is furnished with a plurality of holes, and said swinging arm having a fastening pin to be plugged into one of said holes in said connecting member so as to adjust said leg holder at a height suitable to a user's leg length.

4. A leg exercise device as claimed in claim 1, wherein said supporting frame is pivotally connected with said base plate so as to enable said leg exercise equipment to be folded if necessary.

5. A leg exercise device as claimed in claim 1, wherein said damping device is a hydraulic cylinder.

6. A leg exercise device comprising:

(a) a horizontal base plate, said horizontal base having an area large enough to allow a person to stand thereon;

(b) a vertical supporting frame foldably mounted on said base plate;

(c) a crank mechanism including a swinging arm, a shaft, first and second connecting rods, first and second damping cylinders, and a connecting pin, wherein (i) said shaft is pivotably mounted on said supporting flame, and said connecting pin is fixedly connected to said supporting frame, (ii) said swinging arm and said first and second rods are fixedly connected to said shaft, said first and second rods are connected in a substantially L-shaped manner, and said swinging arm is connected to a joint between said first and second rods, (iii) said first and second damping cylinders are connected to said connecting pin at first respective first ends thereof, and said first and second damping cylinders are connected, at second ends thereof, to said first and second rods, respectively, (d) an adjustable leg holder connected to said swinging arm via a connecting member in a length-adjustable manner so as to adapt to a user's leg length;

(e) whereby when the user's leg applies force to said leg holder causing said swinging arm to pivot about said shaft, said force is resisted by said first damping cylinder when said leg moves in an outward direction and by said second damping cylinder when said leg moves in an inward direction, so as to cause a leg muscle or hip muscle to be exercised evenly.

* * * * *